US011400681B2

(12) United States Patent
Sterner et al.

(10) Patent No.: US 11,400,681 B2
(45) Date of Patent: Aug. 2, 2022

(54) PROCESS AND APPARATUS FOR MAKING A CONTINUOUS WEB OF FIBROUS MATERIAL

(71) Applicant: Giorgio Trani, Venice (IT)

(72) Inventors: Marion Sterner, Venice (IT); Federico Cariolaro, Vicenza (IT)

( * ) Notice: Subject to any disclaimer, the term of this patent is extended or adjusted under 35 U.S.C. 154(b) by 186 days.

(21) Appl. No.: 16/486,903

(22) PCT Filed: Feb. 22, 2018

(86) PCT No.: PCT/IB2018/051097

§ 371 (c)(1),
(2) Date: Aug. 19, 2019

(87) PCT Pub. No.: WO2018/154475

PCT Pub. Date: Aug. 30, 2018

(65) Prior Publication Data

US 2021/0070006 A1 Mar. 11, 2021

(30) Foreign Application Priority Data

Feb. 22, 2017 (IT) ..... 102017000020032

(51) Int. Cl.
*B31F 1/22* (2006.01)
*D21H 25/00* (2006.01)

(52) U.S. Cl.
CPC ..... *B31F 1/22* (2013.01); *D21H 25/005* (2013.01)

(58) Field of Classification Search
CPC ..... B31F 1/14; B31F 1/20; B31F 1/22; B31F 1/26; B31F 1/32; B31F 1/205;
(Continued)

(56) References Cited

U.S. PATENT DOCUMENTS 1,911,001 A * 5/1933 Sheesley ..... B31F 1/12 425/337
2,623,572 A * 12/1952 Haas ..... B31F 1/12 425/396

(Continued)

FOREIGN PATENT DOCUMENTS

GB 682275 11/1952

OTHER PUBLICATIONS

Adiprene/Vibrathane Technical Services, Feb. 14, 2001, Correlation between Durometer (Shore) A and P&J Plastometer Hardness Scales, Compton Uniroyal Chemical (Year: 2001).*

*Primary Examiner* — Anna K Kinsaul
*Assistant Examiner* — Luis G Del Valle
(74) *Attorney, Agent, or Firm* — Themis Law

(57) ABSTRACT

A process for making a continuous web of a longitudinally corrugated fibrous material includes passing the web between a rigid cylinder having circumferential grooves that are flanked and shaped to define a substantially corrugated profile on substantially on the entire thickness of the web, and a presser which has an external layer made of an elastically compressible material and which is maintained adherent to the rigid cylinder so as to cause the continuous web to penetrate into the grooves and thus obtain the corrugations, At the same time, the continuous web is subjected to a reduction of the speed of the surface in contact with the presser with respect to the speed of the surface in contact with the rigid cylinder so as to have a longitudinally corrugated pattern on both surfaces and transverse ripples at least at the corrugated surface that was in contact with the rigid cylinder.

20 Claims, 5 Drawing Sheets

(58) Field of Classification Search
CPC ..... B31F 1/225; B31F 1/242; B31F 1/245; B31F 1/247; B31F 1/2813; D21H 25/005; Y10T 428/24455; Y10T 428/4446
USPC ..... 493/463
See application file for complete search history.

(56) References Cited

U.S. PATENT DOCUMENTS

| | | | | | |
|---|---|---|---|---|---|
| 2,890,515 | A | | 6/1959 | Parker | |
| 3,104,197 | A | * | 9/1963 | Back | D21H 25/005 264/282 |
| 3,290,209 | A | | 12/1966 | Ihrman | |
| 3,300,368 | A | * | 1/1967 | Cooper | B31F 1/00 428/152 |
| 3,880,975 | A | * | 4/1975 | Lundmark | B27N 3/08 264/122 |
| 4,059,482 | A | * | 11/1977 | Kankaanpaa | D21F 3/04 162/305 |
| 5,213,872 | A | * | 5/1993 | Pricone | B32B 7/12 359/530 |
| 5,462,488 | A | * | 10/1995 | McKillip | B42D 5/027 283/67 |
| 5,508,083 | A | * | 4/1996 | Chapman, Jr. | B31F 1/225 156/244.11 |
| 9,034,230 | B2 | * | 5/2015 | Qureshi | A61F 13/51462 264/154 |
| 2001/0048022 | A1 | * | 12/2001 | Zoeckler | B31F 1/22 229/199 |
| 2006/0151914 | A1 | * | 7/2006 | Gerndt | B29C 55/065 425/363 |
| 2009/0029840 | A1 | | 1/2009 | Chen | |
| 2011/0094669 | A1 | * | 4/2011 | Oetjen | B32B 38/04 156/250 |

* cited by examiner

PROCESS AND APPARATUS FOR MAKING A CONTINUOUS WEB OF FIBROUS MATERIAL

FIELD OF THE INVENTION

The present invention relates to a process and to an apparatus for producing a continuous web of a longitudinally corrugated fibrous material.

BACKGROUND OF THE INVENTION

Corrugated paper sheets are known to be used on their own or even coupled with one or more smooth, i.e., non-corrugated, paper sheets, which give the corrugated paper sheet shape stability.

A known technique for making corrugated paper sheets consists in passing a smooth paper sheet between a pair of cylinders, each affected on the whole side surface thereof by radially protruding veinings running parallel to the cylinder axis. The veinings are separated by grooves, in which the veinings of the other cylinder engage, forming a sort of toothed coupling between one another.

If a paper sheet is passed between the two cylinders, it is subjected to a deformation process, which turns it into a sheet corrugated transversely to the passage direction therebetween.

If it is then necessary to obtain a multilayer sheet of corrugated cardboard, two non-corrugated paper sheets are applied to one or both sides of the corrugated paper sheet, which stabilize the shape of the corrugated sheet and globally form the multilayer sheet of corrugated cardboard.

Obviously, the same technique is also applicable to obtain a continuous web of corrugated cardboard, provided that the two cylinders are fed with a continuous web instead of a paper sheet and provided that one or two continuous non-corrugated paper webs are applied thereto, following the passage between the cylinders.

This technique has proven to be valid and is currently very widespread, but has a limitation in that the cardboard obtained is corrugated only in the direction transverse to the forming direction. Furthermore, the web or the multilayer sheet obtained, although having a sufficient folding resistance in the direction orthogonal to the corrugations, it has a limited folding resistance in the direction parallel to the corrugations. As a result, to obtain the same folding resistance in both directions, individual cardboard sheets need to be produced by gluing them together so that they have the corrugations oriented at 90° with respect to one another, and this with a non-continuous process.

Another drawback consists in that, in any case, this known technique does not allow to obtain a continuous paper web corrugated in the longitudinal direction.

To eliminate this limitation, passing a continuous paper web between a pair of cylinders affected by a plurality of circumferential veinings and coupled to one another so that the veinings of a cylinder enter in the grooves of the other cylinder has already been provided, for example in US 2005/0006816. If now a paper web is passed between the two cylinders, this has to follow the profile of the two cylinders and, when exiting therefrom, it should theoretically have assumed a longitudinally corrugated shape.

A drawback of this known solution consists in that the web passing between the two cylinders is affected by the corrugation process over the whole width thereof at the same time, and this determines a frequent longitudinal tearing of the web itself, with a consequent unacceptable production waste, which significantly affects the final cost of the product obtained.

To avoid this drawback, creating the longitudinal corrugations on the paper web starting from the central band towards the edges has already been provided. This solution also has the drawback of causing a significant variation in the overall width of the exiting corrugated web, with respect to the entering flat web. As a result, to obtain an exiting longitudinally corrugated web with a width suitable for satisfying the standard requirements of this industry, it is necessary to feed the forming machine with a paper web with a width far greater than the standard one, with the need to provide, upstream of the forming rollers, a structure supporting the paper roll to be processed with a bulkiness significantly greater than the bulkiness of the forming machine itself. Furthermore, given an equal width of the entering flat web, the width of the longitudinally corrugated web thus obtained is influenced by the shape and size of the corrugations.

Another drawback of this known solution consists in the very poor shape stability of the corrugated web, which tends to elastically regain the flat shape thereof unless it is stabilized, immediately after the forming, by applying a flat paper web thereto.

U.S. Pat. No. 3,104,197 relate to a process for obtaining a paper having a smooth and easily printable surface which may be extended both in the transverse direction and in the longitudinal direction. In particular, this is obtained by passing the starting web between a rigid cylinder provided with veinings and a cylinder externally coated with rubber so as to simultaneously carry out the embossing on the surface in contact with the rigid cylinder and the creping on the surface in contact with the rubber-coated cylinder. The exiting paper has a surface—the one that has come into contact with the rigid cylinder—which is substantially flat and smooth with recesses at the veinings of the rigid cylinder, while the other surface—the opposite one, which has come into contact with the rubber-coated cylinder—is flat with superficial ripples.

U.S. Pat. No. 2,890,515 provides for passing a fabric between a web of a soft material and a rigid cylinder (i.e., of a non-elastic material) which is grooved and is heated. Furthermore, such solution provides for introducing a covering cloth or an endless continuous web of a flexible material between the rigid cylinder and the fabric to be treated, so as to create a ripple effect on the fabric, and this for ornamental purposes only.

SUMMARY OF THE INVENTION

It is the object of the invention to provide a process for making continuous webs of longitudinally corrugated paper devoid of all the drawbacks of the conventional technique and more specifically for making a continuous web of longitudinally corrugated paper with shape stability and with a width equal to the width of the starting flat web.

It is another object of the invention to provide a process for making continuous webs of longitudinally corrugated paper in a simple manner and with a low cost.

It is another object of the invention to provide a process which allows to achieve high production speeds.

It is another object of the invention to provide a process for making continuous webs of longitudinally corrugated paper, with different and improved features.

It is another object of the invention to provide a process for making continuous webs of longitudinally corrugated paper, with which to prepare multilayer corrugated cardboards of different types.

It is another object of the invention to provide a continuous process with which it is possible to produce multilayers having increased flexural resistance, by virtue of the coupling of transversely corrugated webs with longitudinally corrugated webs.

It is another object of the invention to provide an apparatus for making longitudinally corrugated paper sheets/webs starting from non-corrugated paper sheets/webs.

It is another object of the invention to provide a process and/or an apparatus which may be implemented in a simple manner and at a low cost.

It is another object of the invention to provide a process and/or an apparatus having an alternative and/or improved characterization with respect to conventional solutions, both in terms of construction and function.

All these objects, considered both individually and in any combination thereof, as well as others which will result from the following description, are achieved, in accordance with the invention, by a process for producing a continuous web of a fibrous material, in particular of paper, that is longitudinally corrugated, and by an apparatus, as described hereinafter.

BRIEF DESCRIPTION OF THE DRAWINGS

The present invention is further clarified below in some of the preferred embodiments thereof, given purely by way of explanation and not by way of limitation, with reference to the accompanying drawings, in which.

DETAILED DESCRIPTION OF EMBODIMENTS OF THE INVENTION

Figure 1:
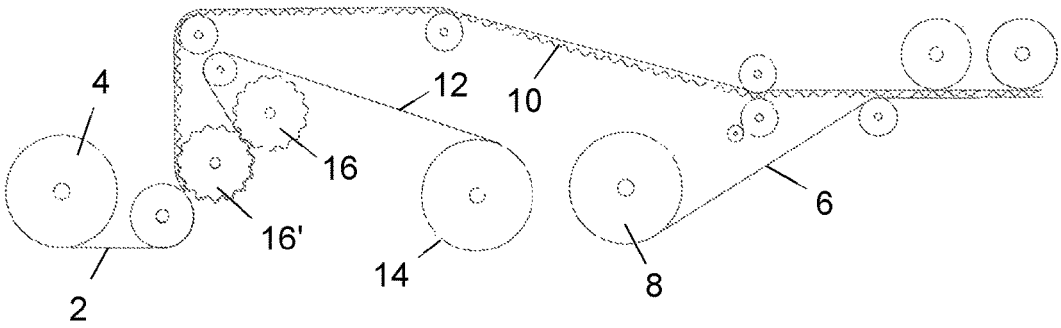
FIG. 1 (PRIOR ART)
FIG. 1 diagrammatically shows a conventional apparatus for producing multilayer cardboard formed by two non-corrugated paper sheets or webs, between which a transversely corrugated paper sheet of web is interposed.

FIG. 1 shows a conventional apparatus for producing a continuous web of multilayer cardboard comprising a first external web 2 of a fibrous material in general and of paper in particular, unwound from a first reel 4, a second external layer 6 of paper, unwound from a second reel 8 and a third layer 10, interposed between the two external layers 2, 6 and formed by a transversely corrugated paper web. It is obtained starting from a flat web 12, unwound from a reel 14 and passed between two forming cylinders 16, 16' affected on the side surface by a plurality of transverse veinings alternating with transverse grooves complementary to the veinings of the other forming cylinder 16', 16.

Unlike the layer 10, corrugated in the transverse direction and not very resistant to foldings parallel to the corrugations, the present invention provides a process and a plant with which a paper web may be obtained, corrugated in the longitudinal direction and resistant to foldings both parallel and orthogonal to the corrugations. Suitably, according to the present invention, the corrugations 26 affect the whole thickness of the paper web thus obtained and, in particular, both surfaces 23, 25 thereof. In particular, the process in accordance with the invention uses:

a rigid cylinder 18, which is affected on the side surface thereof by flanked circumferential grooves 22 reproducing the pattern of the corrugations 26 to be obtained on the whole thickness of the web, and therefore on both surfaces of the web itself, a presser, comprising at least one external layer of an elastically compressible material, which is maintained adherent to said rigid cylinder 18 with a force suitable for making said continuous web 24 penetrate into said grooves 22, and thus obtaining said corrugations 26 affecting the whole thickness of the web itself.

Figure 6:
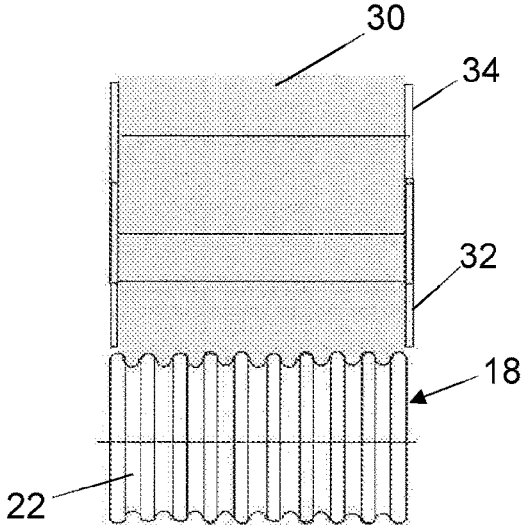
FIG. 6 shows the apparatus in accordance with the front view VI-VI of FIG. 5.
Figure 7:
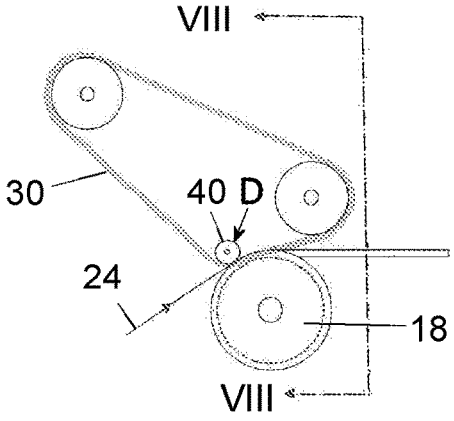
FIG. 7 shows a diagrammatic side view of a third example of an apparatus in accordance with the invention for producing a continuous web of longitudinally corrugated paper starting from a continuous flat paper web.
Figure 8:
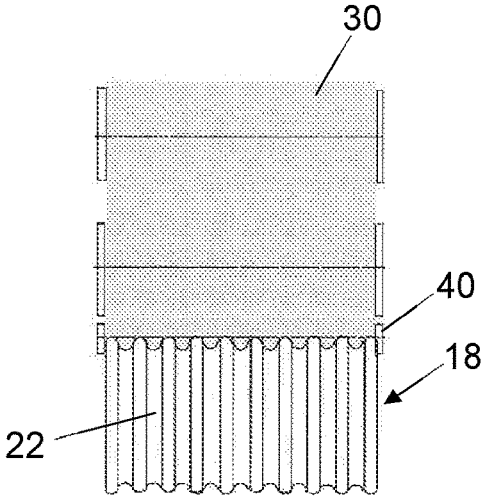
FIG. 8 shows the apparatus in accordance with the front view VIII-VIII of FIG. 7, FIG. 9 diagrammatically shows an enlarged detail of FIG. 7, showing the contact area between two rollers, between which the continuous paper web to be longitudinally corrugated is passed.

Suitably, the presser element may comprise a cylinder 20 coated in an elastically compressible material (see FIGS. 2 and 3) or a web 30 of an elastically compressible material which is pressed against the rigid cylinder 18 by a delimiting element D which may be defined by a rotating element 32 (see FIGS. 5 and 6) or by a fixed element (see FIGS. 7 and 8).

The process in accordance with the invention provides that, when a continuous web 24 of a non-corrugated fibrous material is passed between said rigid cylinder 18 and the presser, said web is also subjected, on at least one segment of the passage thereof between said rigid cylinder 18 and said presser, to a reduction of the speed of the surface 25 thereof in contact with said presser with respect to the speed of the surface 23 thereof in contact with said rigid cylinder.

Suitably, the method in accordance with the invention provides that the force for maintaining the presser adherent to said rigid cylinder and the speed reduction between the two surfaces 23, 25 of the web 24 are mutually defined, so that:

both surfaces 23, 25 of the exiting web 24 have a longitudinally corrugated pattern, and the web 24, when exiting, has transverse ripples (veinings) 27 at least at the corrugated surface 23 which was in contact with said rigid cylinder 18.

Suitably, the rigid cylinder 18 and the presser advance in directions opposite to one another.

The rigid cylinder 18 is affected on the whole side surface thereof by a plurality of circumferential grooves 22 which are flanked and shaped so as to define a substantially corrugated profile reproducing the pattern of the corrugations 26 to be substantially obtained on the whole thickness of the web itself, and in particular on both surfaces 23, 25 of the exiting paper web. The circumferential grooves 18 are configured to produce corrugations 26 on the web that have a depth greater than the entire thickness of the web.

These grooves 22 preferably have a circumferential pattern and may suitably be continuous or discontinuous, and may have, in section, a curved corrugated pattern, preferably sinusoidal, or square wave, or of any other shape.

Also the size of the grooves 22 may vary a lot, depending on the features of the corrugations 26 to be formed on the whole thickness of the paper web—and therefore on both surfaces 23, 25 of the web itself—according to market requirements.

The grooves 22 have a depth and/or a pitch not smaller than 0.5 mm and, preferably, have a pitch and/or a depth of between about 1 and 20 mm and, more particularly, of between about 1.5 mm and 10 mm.

Advantageously, the width (i.e., the transverse development) of the grooves 22 is substantially corresponding to the distance (always in the transverse direction) provided between the adjacent grooves 22. Suitably, this allows to obtain, when exiting, a paper web 24 with corrugations 26 in which portions of concavities, opposite with respect to that of the corresponding adjacent portions, alternate with constant pitch. In particular, preferably, in the exiting paper web 24, the width of the segments raised (and deriving from the entry of the paper into the grooves 22) substantially corresponds to the width of the remaining segments (i.e., those not raised).

Preferably, the presser of an elastically compressible material 20 has a substantially smooth external surface.

Advantageously, the presser of an elastically compressible material 20 has a hardness of between 70 and 240 PJ and preferably of between 120 and 220 PJ.

Suitably, the continuous paper web 24—which is sent entering into the cylinder 18 and into the presser—has a degree of dryness of 40-95%, preferably of 60-85%. Advantageously, said continuous paper web 24, when entering, may be of any type, even of recycled waste fibers.

Furthermore, said entering paper web 24 may be the one which is obtained directly in the paper mill, or may even be the one which, after being dried, is sent to the converter for subsequent processing; in the latter case, then, the paper web is previously wetted, before being sent entering into the cylinder 18 and into the presser. Suitably, this wetting may be obtained by vaporizing or by spraying on the web 24 water or another suitable liquid or by passing the web itself through a tank containing this liquid.

Figure 2:
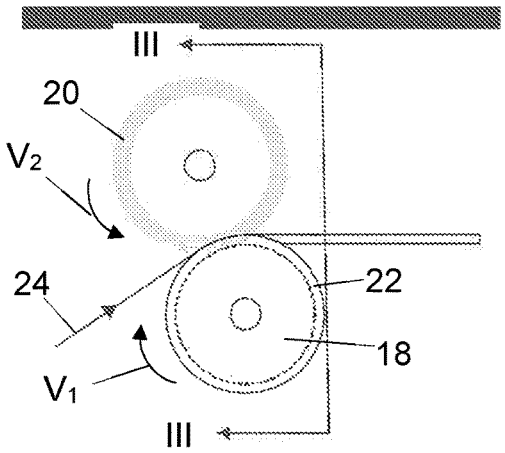
FIG. 2 shows a diagrammatic side view of a first example of an apparatus in accordance with the invention for producing a continuous web of longitudinally corrugated paper starting from a continuous flat paper web.
Figure 3:
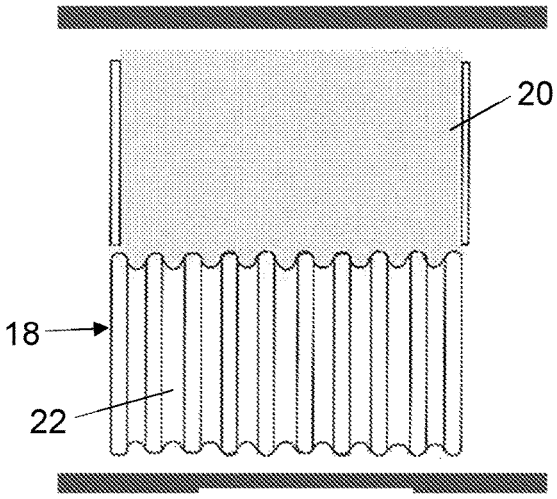
FIG. 3 shows the apparatus in accordance with the front view III-III of FIG. 2.

Advantageously, in a first embodiment, shown in FIGS. 2 and 3, a pair of forming cylinders 18, 20, is provided, of which the cylinder 18 is made of a rigid material, preferably steel, while the cylinder 20 is made, at least externally, of an elastically compressible material, for example rubber or even steel, but with an external rubber coating. Preferably, but not necessarily, the rigid cylinder 18 is located in a lower position with respect to the cylinder of an elastically compressible material 20.

Both cylinders 18, 20 are supported by a suitable structure (not shown) and are associated with respective motors, which drive them in rotation in a direction opposite to one another at different peripheral speeds. Suitably, the cylinders 18, 20 are actuated so as to rotate at different speeds, and respectively at a speed $V_1$ for the rigid cylinder 18 and at a speed $V_2<V_1$ for the cylinder 20 of an elastically compressible material. Preferably, but not necessarily, the cylinder of an elastically compressible material 20 and the rigid cylinder 18 have approximately the same diameter.

The apparatus described herein operates as follows: when a continuous paper web 24 is passed between the two cylinders 18 and 20, the combined effect of the pressure existing in the contact area (nip) thereof and the different speeds thereof ensures that the cylinder 20 of an elastically compressible material presses the surface 23 of the paper web 24 against the rigid cylinder 18 to an extent suitable to lead the paper itself to be inserted into the grooves 22 (even without necessarily adhering to the bottom of the latter) and this effect, combined with the difference in peripheral speed of the two cylinders 18, 20—and therefore the different speed which the two surfaces of the paper web 24 are subjected to—causes a transfer of energy from the cylinder of an elastically compressible material 20 to the surface 25 of the paper itself, to an extent sufficient both to deform the paper web 24, to imprint longitudinal corrugations 26 thereto along the whole width thereof and along the whole thickness thereof, and to create, in particular on the bottom of these corrugations thus obtained, a series of transverse ripples 27 which stabilize the shape of the corrugations themselves, even without the need to apply a flat paper sheet to the corrugated paper sheet as necessarily required by the conventional technique.

Figure 4:
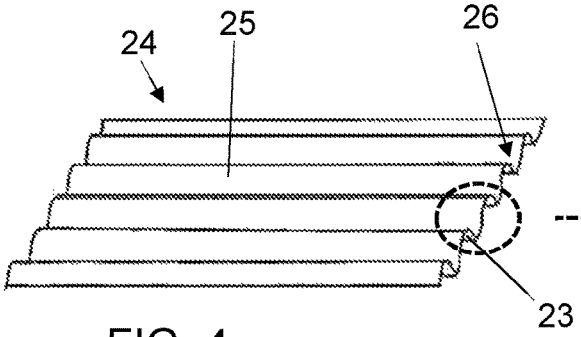
FIG. 4 shows a perspective view of a portion of web obtained by the process in accordance with the invention.
Figure 4A:
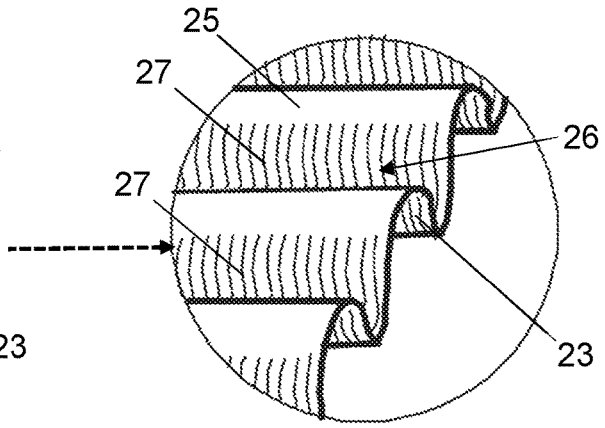
FIG. 4*a* shows an enlarged detail of FIG. 4.

Suitably, a portion of web obtained by the process described herein is shown in FIGS. 4 and 4A. In particular, as shown in FIG. 4, the longitudinal corrugations 26 affect the whole thickness of the exiting paper web 24, and therefore both the surfaces 23 and 25 of the web itself.

Suitably, as shown in FIG. 4A, the transverse ripples 27 mainly and especially affect the surface 23 of the exiting paper web 24, i.e., the surface of the latter which has come into contact with the rigid cylinder 18. Suitably, the transverse ripples 27 may also affect the surface 25 of the exiting paper web 24, i.e., the surface of the latter which has come into contact with the cylinder 20.

Suitably, the exiting paper web 24 has a thickness which has a substantially corrugated pattern and which remains substantially constant both in the longitudinal direction and in the transverse direction. Suitably, the thickness of the paper web 24, when exiting from the passage defined between the rigid cylinder 18 and the presser, is greater with respect to that of the paper web when entering into said passage.

The longitudinal braking given by the different speeds of the two cylinders 18, 20 has a double effect. The first effect consists in that the longitudinal braking determines a longitudinal compaction which is immediately used to obtain a greater transverse development, which in turn allows to obtain the corrugation without reducing the width of the exiting corrugated web. In other words, according to the present invention, if the entering web has a width La and a length Lu, at the exit, the web itself has a width which is still La and a length Lu' with Lu'<Lu. The second effect consists in creating the transverse ripples 27 which give stability to the obtained corrugations.

Figure 5:
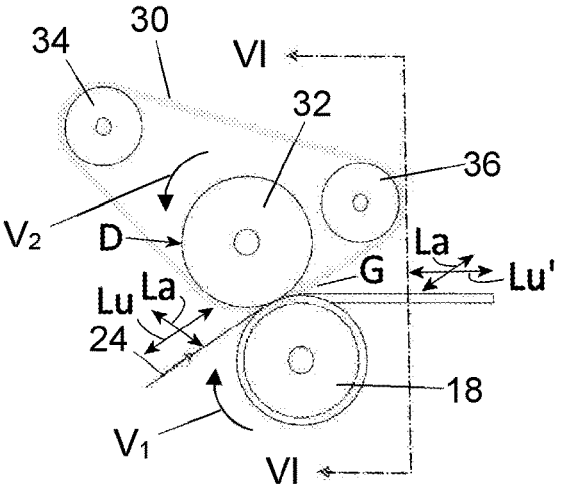
FIG. 5 shows a diagrammatic side view of a second example of an apparatus in accordance with the invention for producing a continuous web of longitudinally corrugated paper starting from a continuous flat paper web.

In the embodiment shown in FIGS. 5 and 6, the rigid cylinder 18, which is circumferentially grooved 18, cooperates with a continuous web 30 of an elastically compressible material instead of with a cylinder of an elastically compressible material.

Preferably, but not necessarily, the rigid cylinder 18 is positioned in a lower position with respect to the web 30. Suitably, the rigid cylinder 18 has one or more of the features described for the previous embodiment.

Advantageously, the web 30 is stretched between a series of return rollers, at least one of which is motorized, and is advanced, as in the case of the previous embodiment, at a peripheral speed $V_2<V_1$, where $V_1$ is the speed of rotation of the rigid cylinder. More particularly, the web 30 is stretched between a first roller 32, which presses it against the cylinder 18, a second roller 34 and a third roller 36, which are respectively located upstream and downstream of the first roller 32*r*.

Also in this case, the apparatus operates as in the previous case, in the sense that the lower peripheral speed V.sub.2 of the web 30, with respect to the peripheral speed V.sub.1 of the cylinder 18, causes on the paper web 24, interposed between the two, a braking effect, which, combined with the pressure exerted by the web itself on the paper web 24, in addition to pressing it on the bottom of the circumferential grooves 22 of the cylinder 18 to create the longitudinal corrugations 26 affecting the whole thickness of the web itself, creates on the bottom of the corrugations thus obtained a series of transverse ripples 27 which stabilize the shape of the corrugations themselves.

Suitably, also in this case, the portion of web obtained is shown in FIGS. 4 and 4A. In particular, also in this case, the longitudinal corrugations 26 affect the whole thickness of the exiting paper web 24, and therefore both the surfaces 23 and 25 of the web itself. Suitably, as shown in FIG. 4A, the transverse ripples 27 mainly and especially affect the surface 23 of the exiting paper web 24, i.e., the surface of the latter which has come into contact with the rigid cylinder 18. Suitably, the transverse ripples 27 may also affect the surface 25 of the exiting paper web 24, i.e., the surface of the latter which has come into contact with the web 30.

Figure 9:
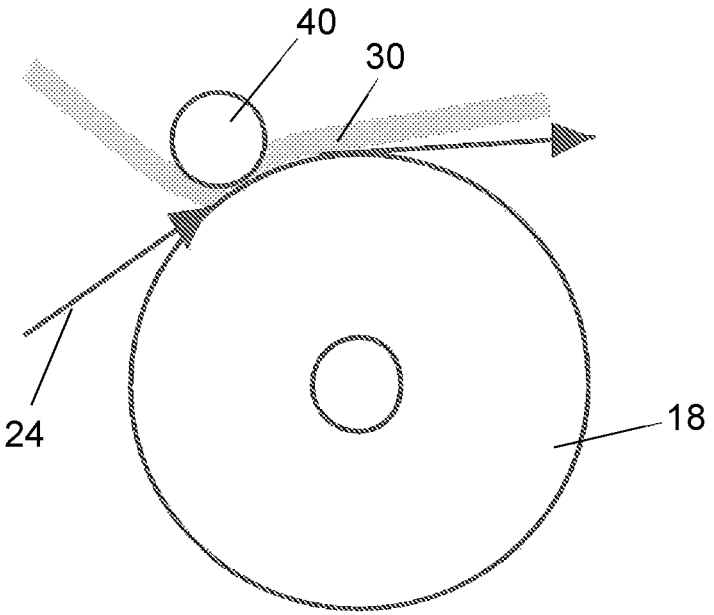

In the embodiment shown in FIGS. 7-9, as in the case of the previous embodiment, a web 30, made of an elastically compressible material and stretched between two or more return rollers, is associated to the circumferentially grooved rigid cylinder 18.

Suitably, in such embodiment, the web 30 is supported and stretched by at least one return element 40 which is fixed, i.e., non-rotating. Advantageously, this fixed return element 40 is defined by a fixed bar. Preferably, the return bar 40 has a significantly smaller diameter with respect to the diameter of the grooved cylinder 18.

Suitably, the fixed return element 40 is positioned and configured so as to locally press the web 30 against said cylinder 18 so as to significantly reduce the thickness thereof and to locally increase, consequently, the peripheral speed thereof in the short area of contact with the grooved cylinder 18.

The various measures involved are sized so that the speed of the web 30 at the point of passage between the roller 32 or the fixed element 40 and the cylinder 18 is equal to the peripheral speed V.sub.1 of the lower cylinder 18.

Also, as soon as the web 30 leaves the passage delimited by the fixed element 40 and by the cylinder 18, it elastically regains the original thickness thereof, with an abrupt increase in thickness and a consequent abrupt decrease in speed, determining a sort of slowing of the paper web 24 with which it is in contact, and with a formation of corrugations 26 and transverse ripples 27, in a similar manner to what already described in the two previous examples.

Advantageously, in a varying embodiment not shown in the drawings, said corrugated web, which exits the passage gap G between the presser of an elastically compressible material and the rigid cylinder 18, is passed between two stabilizing rollers, preferably of steel, with a corrugated profile for pressing the corrugations of said web so as to stabilize and stiffen the corrugations themselves or, possibly, so as to vary and/or define the final shape (which may have a sinusoidal, trapezoidal, V or square/rectangular profile) of said corrugations.

Advantageously, the pitch of the corrugated profile of the two subsequent stabilizing rollers corresponds to that of the rigid cylinder 18. Advantageously, the corrugated profile of the two subsequent stabilizing rollers may have a shape and/or a depth equal to or different from those of the rigid cylinder 18. Suitably, the subsequent stabilizing rollers are activated at a speed corresponding to that of the corrugated web exiting from the passage gap G between the presser of an elastically compressible material and the rigid cylinder 18.

Suitably, in all embodiments, the longitudinal braking—which derives from the different speeds between the surface 23 of the web in contact with the rigid cylinder 18 and the surface of the web 25 which is in contact with the presser element (which may be defined by a cylinder 20 provided, at least externally, with a layer of an elastically compressible material or may be defined by a web 30 of an elastically compressible material which is pressed against the rigid cylinder 18 by a rotating element 32 and/or by a fixed element 40)—simultaneously has two effects connected to one another:

determines a longitudinal compaction which is immediately used to obtain a greater transverse development, which in turn allows the corrugations 26 to be obtained without reducing the width of the exiting corrugated web; essentially, in this way, from an entering web having a width La and a length Lu, an exiting web having a width which is still La and a length Lu' with Lu'<Lu is obtained creates the transverse ripples 27 which give stability to the corrugations 26 thus obtained.

Suitably, in order to obtain such double effect, the longitudinal braking given by the different peripheral speeds of the cylinder 18 with respect to the presser element 20 or 30 is defined on the basis of the force provided to maintain the presser itself adherent to said rigid cylinder 18, and vice versa. In other words, to obtain such double effect, the braking and the force to maintain the presser adherent to said rigid cylinder 18 must be suitably and mutually defined and correlated. Suitably, the greater the braking is, the greater the force is required to maintain the presser itself adherent to said rigid cylinder 18 in order to obtain the aforesaid double effect.

Advantageously, the difference between the peripheral speeds of the cylinder 18 with respect to the presser element 20 or 30 is about 5-30% while the force for maintaining the presser adherent to said rigid cylinder 18 is such that the linear pressure at the contact area (nip) is about 5-50 kg per linear centimeter of length of the contact area (nip).

Suitably, said braking and said force for maintaining the presser adherent to said rigid cylinder 18 depend on the moisture content of the fibers of the web 24 of a fibrous material when entering, on the weight of the web 24 of a fibrous material when entering, on the hardness of the layer of an elastically compressible material of the presser and on the size of the rigid cylinder 18 and of the presser.

Figure 15:
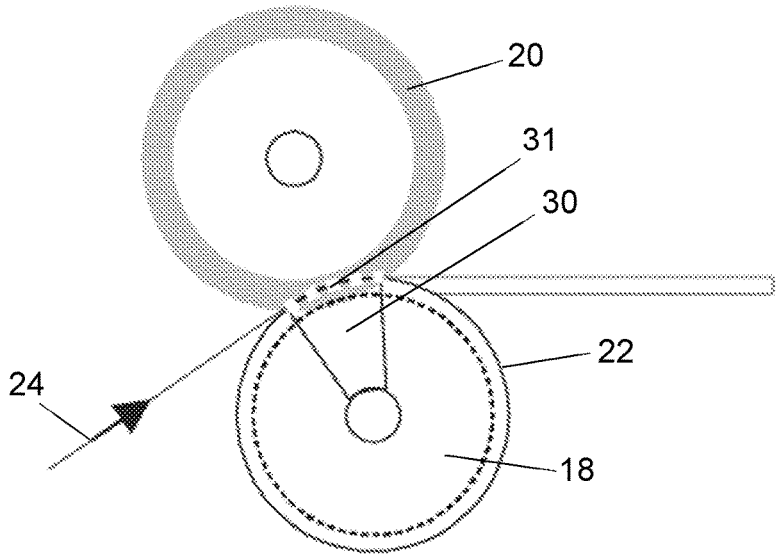
FIG. 15 shows a diagrammatic side view of a fourth example of an apparatus in accordance with the invention for producing a continuous web of longitudinally corrugated paper starting from a continuous flat paper web.

In the embodiment shown in FIG. 15 the forming cylinder 18 is hollow, has the side surface permeable and/or perforated 31 and houses therein a fixed suction chamber 30. It is connected to a suction pump (not shown) and is shaped as a cylindrical section with the two radial walls closed, and is open on the side facing towards the side surface 31 of the cylinder 18 and is affected along the perimeter edge by suitable sealing means sliding with respect to said side surface 31.

The circumferential development of the opening of the suction chamber 30 facing towards the side surface 31 of the cylinder 18 is approximately equal to the circumferential length of the contact band between the cylinder 18 and the corrugated paper web 24 being formed.

The function of this suction chamber 30 is to ensure the adherence of said paper web 24 to the corrugated surface of the cylinder 18, even in the case of great hardness of the rubber forming or covering the cylinder 20 and/or in the case of deep corrugations, which are often desired, given the high dimensional stability which they give to the corrugated web.

Naturally, the suction chamber 30 may advantageously be provided also in the case of a presser consisting of a rubber web 30 instead of a rubberized cylinder 20.

Figure 16:
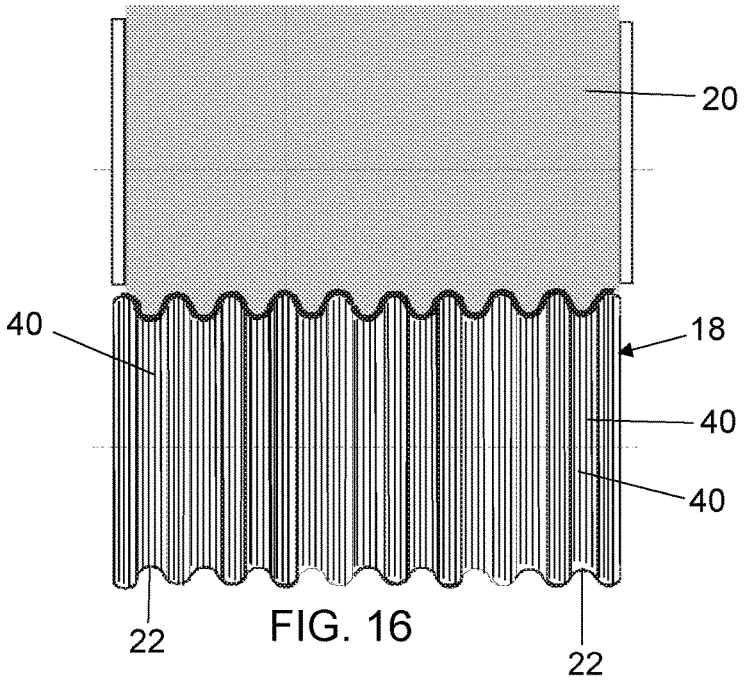
FIG. 16 shows, in the same front view of FIG. 3, a fifth example of an apparatus in accordance with the invention for producing a continuous web of longitudinally corrugated paper with high dimensional stability, again starting from a continuous flat paper web.
Figure 17:
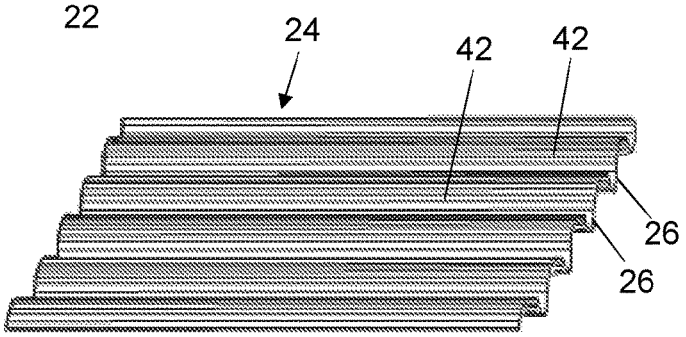
FIG. 17 shows a portion of web obtained by the apparatus of FIG. 16.

In the embodiment shown in FIG. 16, the invention provides that the cylinder 18, in addition to having the side surface affected by the circumferential grooves 22 aimed at creating the longitudinal corrugations 26 in the continuous web, is affected by circumferential incisions 40 in the grooves 22. They are designed to form in the longitudinal corrugations 26 of the corrugated web a series of small veinings 42, which run parallel to the corrugations themselves and give thereto a greater dimensional stability, by virtue of the increase of the deformation resistance thereof, in particular the compression resistance.

Since the paper web 24 to be transversely corrugated must have a certain plasticity to be able to enter into the small incisions 40 obtained in the transverse grooves 22 of the rigid cylinder 18, and since the water content present in the paper web 24 may not be sufficient to give this plasticity required, it is also provided that, before the introduction thereof between the cylinder 18 and the presser 20, 30 it is subjected to wetting, to an extent suitable for bringing the dry content thereof to the optimum value, which is generally of between 40 and 95%, and is preferably of between 70 and 85%. Suitably, this wetting may be obtained by vaporizing or by spraying on the web 24 water or another suitable liquid or by passing the web itself through a tank containing this liquid.

Regardless of the type of apparatus used and the operating parameters selected, in any case, the process in accordance with the invention and the machine allowing it to be implemented are somewhat more advantageous than conventional techniques for making the continuous web of longitudinally corrugated paper, and in particular:

allow to continuously obtain longitudinally corrugated webs with high production rates, allow to obtain longitudinally corrugated webs with shape stability, and therefore webs which do not require the application of flat webs to stabilize a shape otherwise destined to lose the corrugated shape thereof over time, allow to obtain longitudinally corrugated webs of a width equal to the width of the entering flat web to be corrugated, allow to obtain longitudinally corrugated webs starting from fibrous webs of any type, extensible and non-extensible, both natural and synthetic, as well as blends, non-woven fabric, etc., allow to obtain longitudinally corrugated webs characterized by particularly deep corrugations, provided that they feed the plant with extensible paper obtained in any case; for example, if feeding the system with non-extensible paper allows to obtain corrugations with a depth of 2 mm, feeding the system with extensible paper (for example 8×8, 15×15 and 20×20) allows to obtain corrugations with depths of over 4 mm, allow to obtain longitudinally corrugated webs directly in the paper mill during the production thereof or at the transformer, which received a continuous web roll from the paper mill and submits it to the longitudinal corrugation process described herein, after having possibly subjected it to a moisturizing step with a possible subsequent drying.

In particular, unlike U.S. Pat. No. 3,104,197, the present invention allows to obtain paper with an overall pattern which is longitudinally corrugated for the whole thickness thereof and, in particular, in which the two opposite surfaces of the paper have both a longitudinally corrugated pattern. On the contrary, the solutions of U.S. Pat. No. 3,104,197 envisage carrying out an embossing, such to create recesses which exclusively affect the external surface of the paper web which comes into contact with the rigid cylinder, and therefore do not create longitudinal corrugations affecting the whole thickness of the web itself; in particular, this is due to the fact that in U.S. Pat. No. 3,104,197 the pressure between the rigid cylinder and the presser at the contact area (nip) thereof is very light, for example, it is of about 1.8 Kg per linear centimeter of nip (i.e., 10 pounds per linear inch). Furthermore, the present invention allows to obtain paper with transverse ripples which are present also and especially at the surface which was in contact with the rigid cylinder, while in U.S. Pat. No. 3,104,197 the transverse ripples are present only at the surface which was in contact with the element of an elastically compressible material while the other surface (the one which was in contact with the rigid cylinder) must necessarily be smooth in order to be printed. Preferably, the longitudinally corrugated paper web, obtained by the process described herein, may then be wound in a roll, just as it has been formed, and be transferred to a user, or may be coupled with another material to form a multilayer web with particular features.

Figure 10:
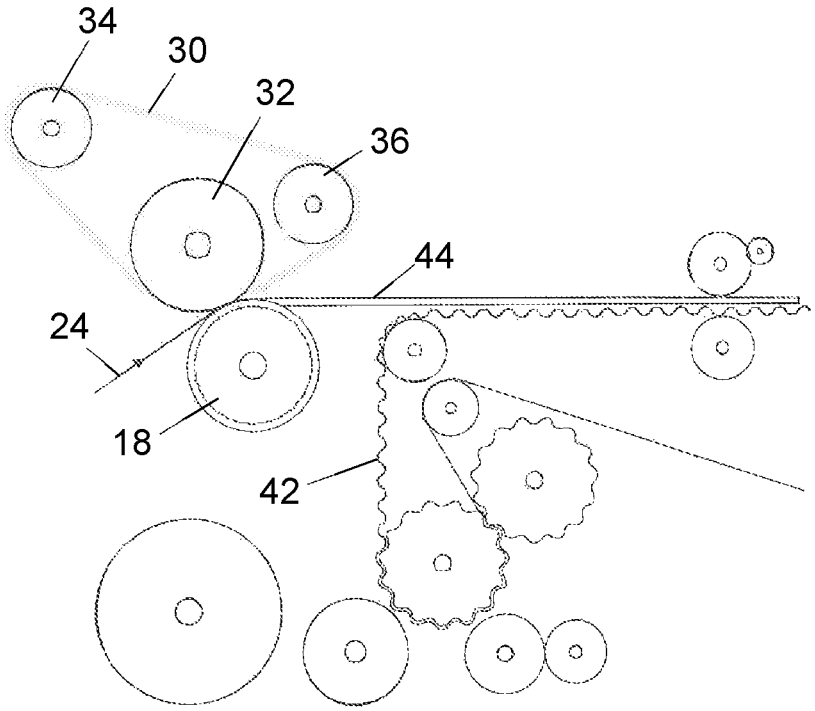
FIG. 10 shows, in the same view of FIG. 1, an apparatus for producing multilayer cardboard formed by the coupling of a longitudinally

In particular, a paper web affected by transverse corrugations may be preferably applied to the web affected by the longitudinal corrugations, preferably in the same line and continuously, and this with an apparatus shown in FIG. 10, which differs from a conventional apparatus, of the type shown in FIG. 1, in that it carries out the coupling of a paper web 42, corrugated transversely with conventional techniques, with a paper web 44 corrugated longitudinally with techniques in accordance with the invention.

Figure 11:
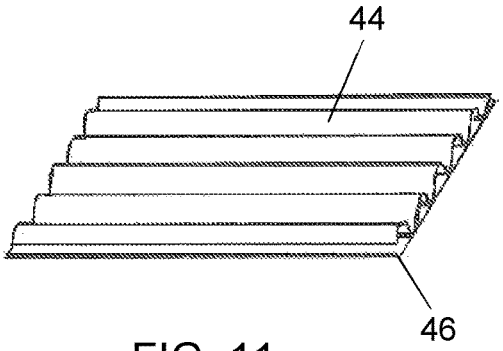
FIGS. 11-14 show portions of webs of different types obtainable by the process in accordance with the invention.
Figure 12:
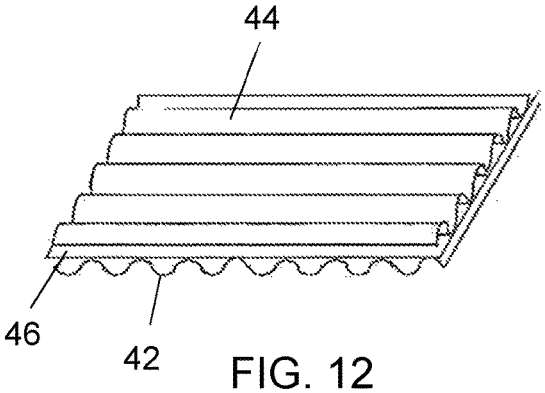
Figure 13:
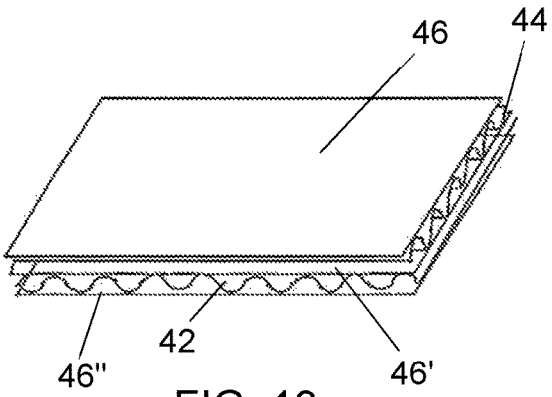

However, it is understood that other couplings may be carried out, preferably in the same line and continuously, using differently obtained paper webs, such as, for example, a longitudinally corrugated paper web 44 with a flat paper web 46 (see FIG. 11) or a longitudinally corrugated paper web 44 with a flat paper web 46 and with a subsequent transversely corrugated paper web 42 (see FIG. 12) or a longitudinally corrugated paper web 44 with two flat paper webs 46, 46', to one of which is then applied a transversely corrugated paper web 42 and a subsequent flat paper web 46" (see FIG. 13).

Figure 14:
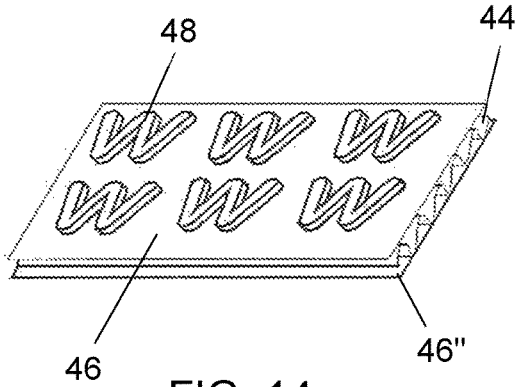

Furthermore, one or both of the external flat paper webs 46, 46', if made of extensible paper, may be affected by drawings 48 or by other ornamental and/or structural motifs, obtained by stretching between embossing rollers, precisely exploiting the extensibility features of the webs themselves (see FIG. 14).

Advantageously, a layer of a polymeric material may be applied, preferably continuously, to the web obtained in accordance with the invention and affected by the longitudinal corrugations 26 and by the transverse ripples 27.

Advantageously, in accordance with the invention, in all the cases described herein, the coupling between the layers may be obtained at the ridges of the corrugations 26 by gluing or by clinching (in particular for tissue-type papers) or by other known techniques; and in all these cases, the features of the multilayer obtained, in addition to improving the folding resistance of the multilayer itself, make such resistance isotropic, i.e., substantially equal in each direction.

The invention claimed is:

1. A process for making a continuous web of a longitudinally corrugated fibrous material, comprising:

passing a continuous web of a non-corrugated fibrous material having a degree of dryness between 60% and 80% and two surfaces between:

a rigid cylinder having, on a side surface thereof, circumferential grooves which are flanked and are shaped so as to define a substantially corrugated profile reproducing a pattern of longitudinal corrugations on both sides of the continuous web to be obtained substantially on an entire thickness of the continuous web, said longitudinal corrugations having a depth greater than the entire thickness of said continuous web, and a presser comprising an external layer made of an elastically compressible material and maintained adherent to said rigid cylinder with a force sufficient for maintaining said presser adherent to said rigid cylinder and for causing said continuous web to penetrate, with the entire thickness of the continuous web, into said circumferential grooves and thus obtaining said corrugations affecting the entire thickness of the continuous web; and at a same time, subjecting said continuous web, on at least one segment of a passage thereof between said rigid cylinder and said presser, to a reduction of a speed of one of the two surfaces of the continuous web in contact with said presser with respect to a speed of another one of the two surfaces of the continuous web in contact with said rigid cylinder, said force for maintaining said presser adherent to said rigid cylinder and said speed reduction between said two surfaces of the continuous web being mutually defined so that the continuous web exiting from said passage has:

a longitudinally corrugated pattern on both surfaces of said web, and ripples extending in a direction transverse to said longitudinal corrugated pattern on at least the surface which was in contact with said rigid cylinder, said process further comprising:

setting a difference between the speed of the surface of said continuous web in contact with said presser with respect to the speed of the surface of said continuous web in contact with said rigid cylinder at 5-30%; and causing said force for maintaining the presser adherent to said rigid cylinder to generate, at a contact area or nip, a linear pressure of 5-50 Kg per linear centimeter of length of the nip.

2. The process according to claim 1, further comprising the step of causing the web, when exiting said passage, to have transverse ripples also at the surface which was in contact with said presser.

3. The process according to claim 1, wherein the rigid cylinder causes the substantially corrugated profile defined by said grooves to have a depth and/or a pitch not smaller than 0.5 mm.

4. The process according to claim 1, wherein said force for maintaining said presser adherent to said rigid cylinder and said speed reduction between said two surfaces of the web are defined, so that the web, when exiting from said passage, has a thickness which remains substantially constant both in a longitudinal direction and in a transverse direction.

5. The process according to claim 1, wherein said force for maintaining said presser adherent to said rigid cylinder and said speed reduction between said two surfaces of the web are defined, so that the web, when exiting from said passage, has a thickness which is greater than a thickness of the web when entering into said passage.

6. The process according to claim 1, wherein said force for maintaining said presser adherent to said rigid cylinder and said speed reduction between said two surfaces of the web are defined, so that the web, when exiting said passage, has a width substantially corresponding to a width of the web when entering into said passage.

7. The process according to claim 1, wherein said force for maintaining said presser adherent to said rigid cylinder and said speed reduction between said two surfaces of the web are defined, so that the web, when exiting said passage, has a length which is smaller with respect to a length of the web when entering into said passage.

8. The process according to claim 1, wherein the rigid cylinder has the side surface defined by the circumferential grooves which in an either continuous or discontinuous pattern.

9. The process according to claim 1, wherein the presser has the external layer of the elastically compressible material with a hardness of between 70 and 240 PJ.

10. The process according to claim 1, wherein the presser comprises at least one rotating element which has the external layer of the elastically compressible material and which is in contact with the surface of said web.

11. The process according to claim 1, wherein said presser consists of a pressure cylinder having, at least on the external layer of the side surface of the presser, the elastically compressible material.

12. The process according to claim 11, wherein said pressure cylinder is advanced at a peripheral speed lower than a peripheral speed of said rigid cylinder.

13. The process according to claim 1, wherein the presser comprises a web of the elastically compressible material maintained locally pressed against said rigid cylinder by a delimiting element adapted to delimit a passage gap between the presser and the rigid cylinder.

14. The process according to claim 13, wherein said delimiting element comprises a rotating element or a fixed element.

15. The process according to claim 13, wherein said web of the elastically compressible material is advanced at a peripheral speed lower than a peripheral speed of said rigid cylinder.

16. The process according to claim 13, wherein a peripheral speed of said web of the elastically compressible material, a peripheral speed of said rigid cylinder and a passage gap between said rigid cylinder and said delimiting element are selected, so that said peripheral speeds of said web and said rigid cylinder at said passage gap are substantially equal.

17. The process according to claim 1, wherein said web, which exits a passage gap between said presser and said rigid cylinder, is coupled with at least one non-corrugated web of a fibrous material.

18. The process according to claim 1, further comprising the step of applying a suction on the continuous web and causing the continuous web to adhere to the rigid cylinder by providing the rigid cylinder with the side surface that is permeable and/or perforated and with a suction chamber therein, so that, during the passage of said continuous web between said rigid cylinder and said presser, a depression is created on a portion of the side surface of said rigid cylinder in contact with said continuous web.

19. The process according to claim 1, wherein said continuous web of a fibrous material is caused to adhere to the side surface of said rigid cylinder, which has, in addition to the grooves, also circumferential incisions in said grooves.

20. An apparatus for making a continuous web of a longitudinally corrugated fibrous material, comprising:

a rigid cylinder having, on a side surface thereof, circumferential grooves which are flanked and are shaped so as to define a longitudinally corrugated profile reproducing a pattern of longitudinal corrugations on both sides of the continuous web to be obtained substantially on an entire thickness of the continuous web, said longitudinal corrugations having a depth greater than the entire thickness of said continuous web; and a presser comprising an external layer made of an elastically compressible material and maintained adherent to said rigid cylinder with a force sufficient for maintaining said presser adherent to said rigid cylinder and for causing said continuous web to penetrate into said grooves and thus obtaining said longitudinal corrugations affecting the entire thickness of the web;

wherein said rigid cylinder and said presser have different speeds so as to subject said continuous web, on at least one segment of a passage thereof between said rigid cylinder and said presser, to a reduction of a speed of one of the two surfaces of the continuous web in contact with said presser with respect to a speed of another one of the two surfaces of the continuous web in contact with said rigid cylinder, said force for maintaining said presser adherent to said rigid cylinder and said speed reduction between said two surfaces of the web being mutually defined so that the web exiting from said passage has:

a longitudinally corrugated pattern on both surfaces of said web, transverse ripples at least at the surface which was in contact with said rigid cylinder, wherein the rigid cylinder with the side surface that is permeable and/or perforated and with a suction chamber therein, so that, during the passage of said continuous web between said rigid cylinder and said presser, a depression is created on a portion of the side surface of said rigid cylinder in contact with said continuous web.

* * * * *